US005273149A

United States Patent [19]

Aldrich et al.

[11] Patent Number: 5,273,149

[45] Date of Patent: Dec. 28, 1993

[54] REVERSE VENDING MACHINE WITH ROTARY-BRISTLE-DRIVE SCANNING STATION

[75] Inventors: Stuart R. Aldrich, Portland, Oreg.; Ronald F. Golownia, Mequon, Wis.

[73] Assignee: Can & Bottle Systems Inc., Portland, Oreg.

[21] Appl. No.: 825,965

[22] Filed: Jan. 27, 1992

[51] Int. Cl.[5] ..... G07F 7/06

[52] U.S. Cl. ..... 194/205; 198/625; 198/659; 209/701

[58] Field of Search ..... 194/205, 208, 209, 212, 194/213; 209/538, 701; 198/625, 663, 659, 676

[56] References Cited

U.S. PATENT DOCUMENTS 4,192,418 3/1980 Montgomery ..... 198/659
4,496,086 1/1985 Duchadeau ..... 198/659 X
4,566,583 1/1986 Schneider ..... 198/659 X
4,653,627 3/1987 Hampson et al. ..... 194/209
4,717,026 1/1988 Fischer et al. ..... 194/205 X

*Primary Examiner*—F. J. Bartuska
*Attorney, Agent, or Firm*—Kolisch, Hartwell, Dickinson, McCormack & Heuser

[57] ABSTRACT

A system, such as a reverse vending machine, for handling redeemable beverage containers of the type carrying side-borne, optically readable information codes. Featured in the machine specifically described herein is a scanning station along the sides of which are plural elongate rotary brushes whose bristles engage an endofed end for the purpose of both propelling it through the station for further processing, and for spinning it within the station for presentation for reading by an outboard optical scanner of the information code carried on the container.

6 Claims, 2 Drawing Sheets

REVERSE VENDING MACHINE WITH ROTARY-BRISTLE-DRIVE SCANNING STATION

BACKGROUND AND SUMMARY OF THE INVENTION

This invention pertains to a system, such as a reverse vending machine, for handling redeemable beverage containers (and the like) of the type carrying side-borne, optically readable information codes, such as conventional bar codes. More specifically, the invention pertains to rotary bristle means or mechanism which acts in such a system (machine) to propel successive containers of the type mentioned in an endo-pass-through-fashion, and with rotary motion, through a scanning station wherein information codes carried on the sides of the containers can be read by an optical scanner, or scanning means, located outside of the station. The scanner produces an output signal related to each code that is read, which signal is interpretable to indicate the information content of such code, thus to develop usable data relating to the handling/redemption process. A preferred embodiment of this mechanism is specifically illustrated and described herein in the setting of a reverse vending machine, wherein it has been found to offer particular utility. We recognize, however, that, beyond the specific setting of a reverse vending machine, our novel bristle mechanism can be used advantageously and effectively in various other particular kinds of systems and machines which handle, for various reasons, redeemable, coded beverage containers of the type mentioned above.

Many so-called "bottle bill" states now exist in which beverage containers, such as aluminum, soft-drink beverage cans, must carry a redemption deposit as a technique for encouraging recycling. In other states, major efforts are afoot to encourage voluntary recycling of such beverage containers, even in the absence of a required redemption deposit. To this end, various people have sought to develop various conveniently usable machines and techniques for intaking, or reverse vending, such containers.

A very satisfactory machine of the type just generally referred to is illustrated and described in U.S. Pat. No. 4,653,627, issued Mar. 31, 1987 to Hampson et al., for REVERSE VENDING MACHINE. The present invention offers a significant container-handling improvement employable in a machine of the type described in this patent, and accordingly, a preferred embodiment of the invention is described herein in the incorporation setting of such a machine. Both to simplify disclosure details in the present document, and to set an appropriate environmental background for focusing attention on the features of the instant invention, the same is described specifically in the environs of a '627 machine, and the entire contents of the '627 patent are hereby incorporated by reference.

As will become apparent from the description that follows, in the machinery shortly to be described, containers (cans) to be redeemed are dumped into a hopper through a user-accessible door in a cabinet or housing for the machine, and from this hopper, such cans are plucked seriatim by a rotary, carrousel-like conveyor which turns on substantially a horizontal axis and lifts cans to an overhead discharge station from which they are released, and initially transported by gravity for further processing. If an additional "downward launch" assist is desired in the discharge station, an appropriate airjet system may be incorporated and used.

It is at the location immediately below this discharge station that the unique apparatus of the present invention functions to facilitate such further processing. Here, a suitable "funnel-like" intake throat is formed by suitable vanes, which direct successively discharged cans, in an endo-fashion, toward an underlying scanning station, distributed around the sides of which are three, elongate, generally upright, equally angularly distributed, rotary brushes, also referred to herein as bristle means. Sprially organized bristles in these brushes engage successive cans and function both to aid gravity in propelling the cans downwardly to pass through the scanning station, and also, significantly, to establish positive, relatively high-speed can rotation.

A conventional optical scanner, referred to herein as a scanning means, "peers" into a side of the scanning station, in the region between a pair of adjacent brushes, to read (optically) the information contained on bar codes printed (or otherwise presented) on the sides of the spinning cans. Bristle-spinning of the cans assures that, as they travel downwardly through the scanning station, their respective bar codes will be readable by the scanner.

The scanner develops, conventionally, an output signal related to the information contained in read bar codes, and cooperating with an interconnected, on-board computer, develops suitable redemption data.

Cans which have passed through the scanning station are further processed for redemption in ways discussed and suggested in the '627 patent, which ways are not germane to an understanding of the present invention.

Various other features, objects and advantages attained by the present invention, will become more fully apparent as the description that now follows is read in conjunction with the accompanying drawings.

DETAILED DESCRIPTION OF, AND BEST MODE FOR CARRYING OUT, THE INVENTION

Figure 1:
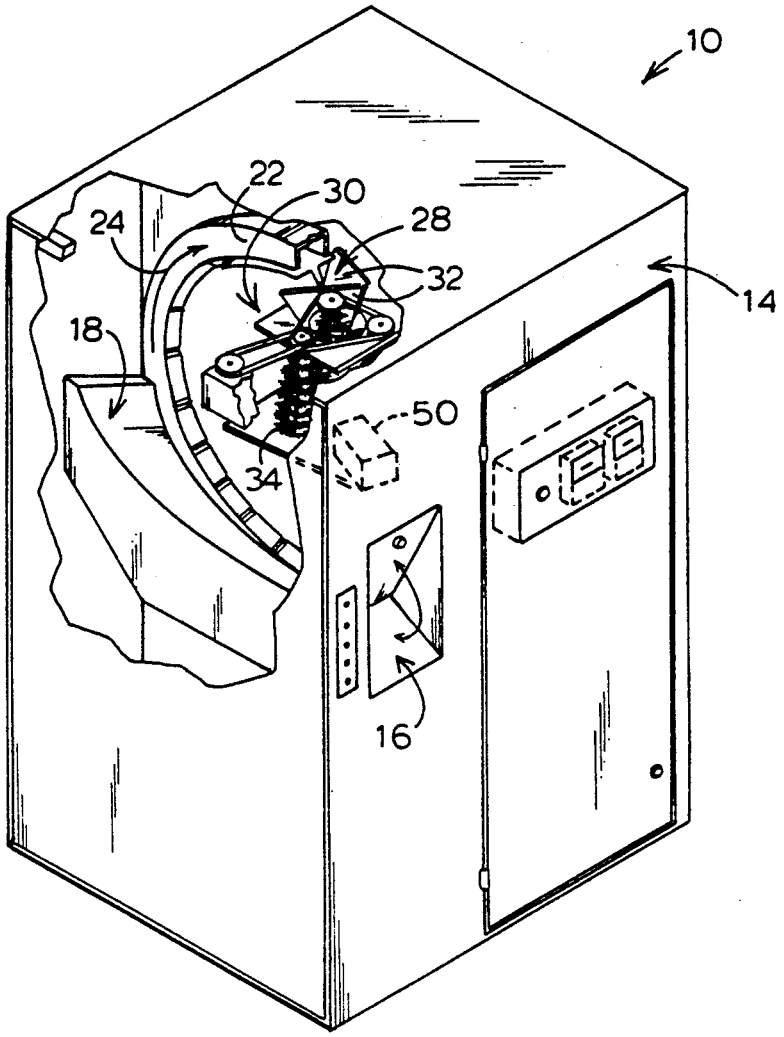
FIG. 1, which is drawn from FIG. 1 in the '627 patent, is a perspective view of a reverse vending machine constructed with rotary bristle drive mechanism designed in accordance with the present invention—portions of the machine being broken away to illustrate interior construction.
Figure 2:
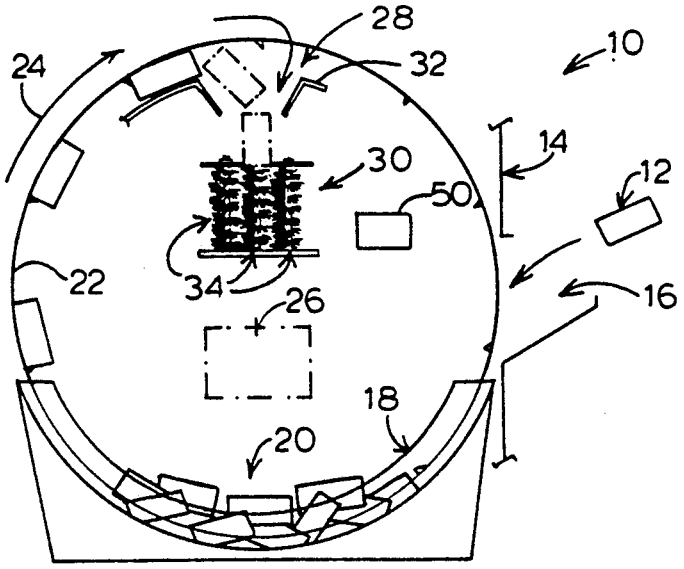
FIG. 2 is a simplified, and highly schematic, view generally illustrating the passage of a redeemable container (can) into and through the machine of FIG. 1, with a portion of this "passage" taking place through the rotary bristle mechanism featured by the present invention.
Figure 6:
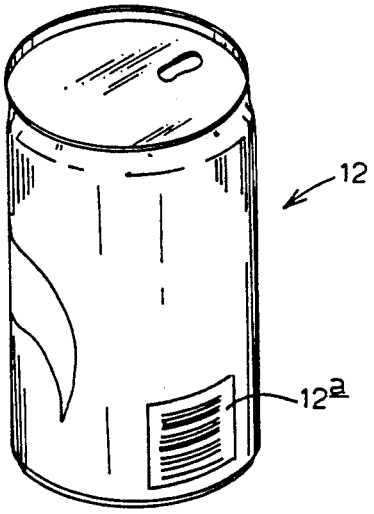
FIG. 6 illustrates a typical, redeemable, soft-drink container (can) of the type bearing on its side an optically readable bar code.

Turning now to the drawings, and referring first of all to FIGS. 1 and 2, indicated generally at 10 is a reverse vending machine for redeemable beverage containers (and the like) of the type carrying side-borne, optically readable information codes, with machine 10 incorporating rotary-bristle-drive apparatus constructed in accordance with the present invention. Deflecting attention for just a moment to FIG. 6, here there is indicated, generally at 12, a conventional, soft-drink, aluminum beverage can, on the side of which is printed a conventional bar code, shown generally at 12*a*, which code carries various well-known identifying information that is readable and interpretable by conventionally, commercially available optical scanners, such as a laser scanner. Machine 10, and the apparatus incorporated therein constructed in accordance with the present invention, are intended to handle the reverse vending of a container such as container 12.

Substantially all of the mechanism which makes up machine 10 is incorporated within a housing, or cabinet, 14 through a user-openable (accessible) side door 16 in which users can dump a collection of to-be-redeemed beverage containers into a collection bin, or hopper, 18. Within hopper 18, which is constructed in accordance with the teachings of the '627 patent referred to above, the collection of dumped containers, shown generally at 20 in FIG. 2, shifts by gravity downwardly toward the lower, inner perimetral portion of a large rotary carrousel conveyor ring 22 which turns herein under machine-drive power in the direction of arrow 24 about a generally horizontal axis, shown at 26 in FIG. 2. Individual container-receiving compartments formed on the inner circumference of ring 22 collect cans seriatim from the hopper, and transport them toward the upper end of machine 10, and specifically toward a release, or discharge, station indicated generally at 28.

Everything so far described in machine 10 is detailed in the '627 patent.

Disposed in machine 10, immediately below discharge station 28, is a scanning station 30, which exists in accordance with the present invention, adjacent the upper end of which are plural, radially-distributed, downwardly and inwardly inclined vanes 32 which form a funneling intake throat for receiving successive cans dropped (released) by gravity from the conveyor ring immediately above station 30. In FIG. 2 the dropping-progress of such a can is illustrated in time progression by dash-dot lines. Vanes 32 aid in collecting such cans, and in orienting them in a generally upright fashion for what is referred to herein as endo-pass-through-feed downwardly through station 30.

Considering now FIGS. 3 and 4 along with FIGS. 1 and 2, disposed immediately below vanes 32 (omitted from FIGS. 3 and 4) are three, equally-angularly-radially-disposed, elongate, upright rotary brushes, or bristle means, which are distributed along the sides of the scanning station for the purpose of receiving, contacting, rotating and downwardly thrusting (transporting) cans which are successively discharged from ring 22.

Figure 3:
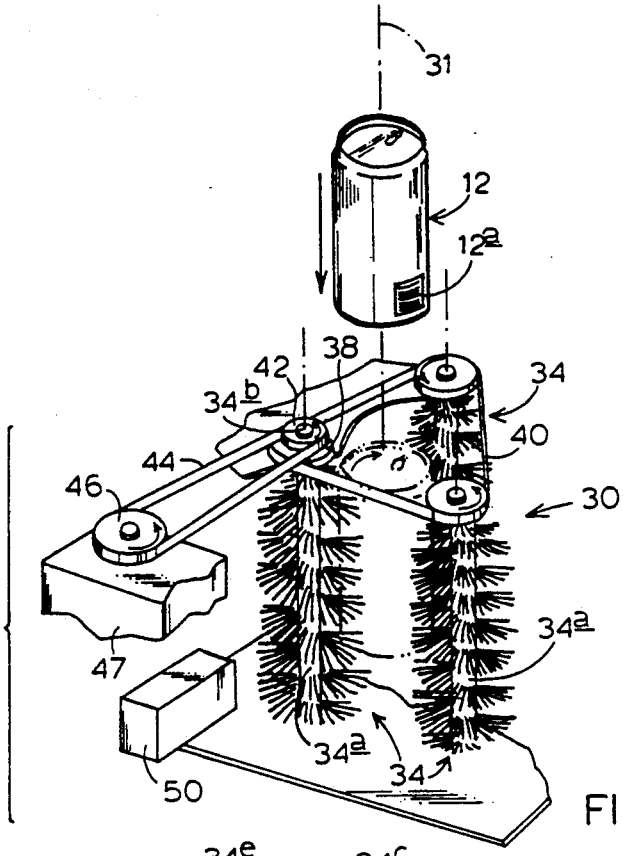
FIG. 3 is a simplified perspective view illustrating, and isolating, the rotary bristle mechanism (means) of the invention.
Figure 4:
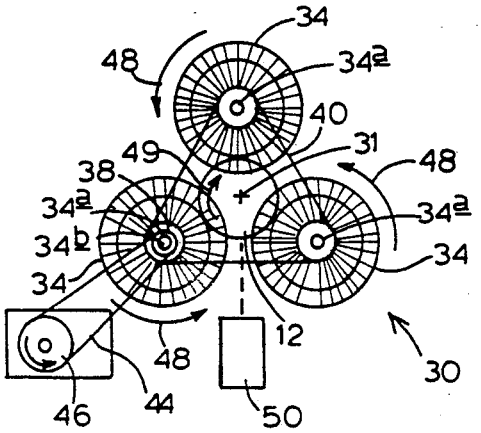
FIG. 4 is a simplified, top-plan view of the rotary bristle mechanism of FIG. 3.
Figure 5:
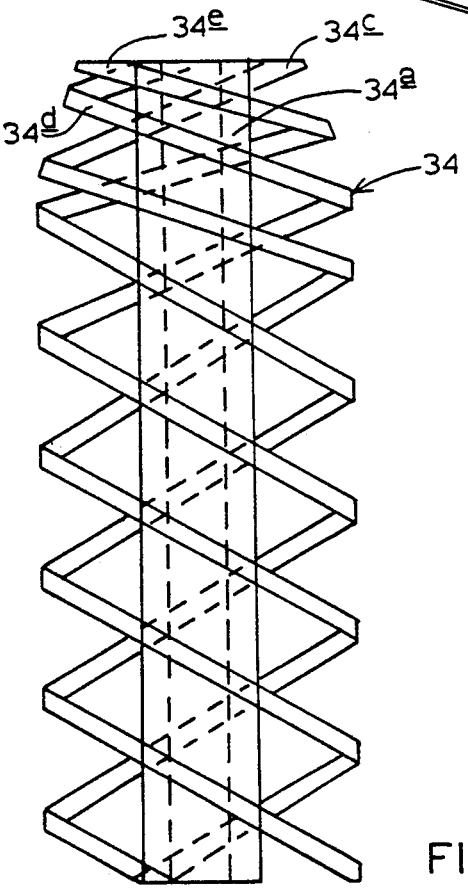
FIG. 5 illustrates, in side view, the construction of one of the brushes which forms part of the bristle mechanism of FIGS. 3 and 4.

Bringing into consideration FIG. 5 along with FIGS. 1–4, inclusive, the three brushes illustrated herein are designated each with the reference numeral 34. Each brush includes an elongate (herein about 10-inches) central cylindrical body 34*a*, having a diameter of about 1-inch, with opposite ends of this body being mounted through stub shafts, such as stub shaft 34*b*, for rotation in suitable journal bearings (not shown) mounted in any appropriate selectible manner on the frame in machine 10. Pulleys, such as pulley 38, carried on the upper stub shafts provided for the brushes' bodies are interconnected by a drive belt 40. And, a single pulley 42 mounted on one of the stub shafts (as shown) is drivingly connected through a belt 44 to a motor-driven pulley 46. The motor which drives pulley 46 is conventional, is suitably mounted on the frame of machine 10, and is shown at 47.

Distributed along body 34*a* in each brush are three spiral coils, such as coils 34*c*, 34*d*, 34*e*, of radially outwardly projecting, flexible nylon (or other suitable flexible material) bristles. In the preferred embodiment of the invention which is now being described, the free ends of these bristles, progressing downwardly from the top of a brush, are characterized by differentiated-diameter characteristics, and the spiral pattern formed by the three coils is characterized, progressing in the same direction along the brush, by what is referred to herein as a change-pitch characteristic. With respect to free-end bristle diameter characteristics, and as can be seen particularly in FIG. 5, the outer ends of the bristles in the coils extend to a diametral distance of about 3¼-inches adjacent the top of each brush, tapering gradually toward a diametral extension of about 4-inches approximately 1½-inches downwardly along the length of the body in the brush. From this point downwardly along the brush, the free-end diameter extension of the bristles remains substantially constant at about 4-inches.

In the upper 1½-inch length of each brush, the apparent, or effective, bristle coil pitch herein is about 1.2-turns per inch, and thereafter below is about 0.7-turns per inch.

These differentiated-diameter and change-pitch characteristics may be specifically different for different applications, but for the application now being described, have proven to offer some functional advantages.

Referring specifically to FIGS. 3 and 4, what might be thought of as the central or pass-through axis of scanning station 30 is shown at 31, and nominally, each can which passes through the station travels with its long axis essentially coincident with axis 31. The rotational axes of the three rotary brushes are spaced apart equally, and are spaced from axis 31 by a distance of about 2¾-inches. Given these conditions, and under circumstances with respect to the usual soft-drink beverage can which has a diameter of about 2½-inches, with a can contacted by the bristles in the three brushes, there is what might be thought of as an interference overlap between the outer perimeter of the can and the would-be outer diametral dimensions or expanse of the bristles of about ½-inch. This, of course, results in the outer ends of the contacting bristles flexing, and thus applying appropriate force to the side of the can both to spin it, to retain it substantially centered on axis 31, and to propel it with a gravity-aiding force downwardly through station 30.

With machine 10 in operation, the motor that drives pulley 46, and therefore ultimately all three of the brushes, rotates these brushes (as indicated by arrows 48) at a speed which is certainly a matter of choice. From experience, a very successful rotary speed is about 260-rpm. Under these circumstances, a container contacted by the bristles in the brushes is spun at the rate of about 300-rpm (in the direction of arrow 49 in FIG. 4), and, in addition, is propelled downwardly through the scanning station not only by gravity, but also under the urging of the moving, contacting, spirally organized brush bristles.

Suitably mounted on the frame of machine 10 within housing 14, to one side of scanning station 30, is a conventional optical scanner, such as the one shown generally in block form at 50 in FIGS. 1–4. Scanner 50 "peers" into the scanning station between two of the brushes to read information contained within the bar codes of successive cans which travel downwardly under rotation between the brushes through the scanning station. This scanner, as is well understood by those skilled in the art, produces an output signal which is interpretable to indicate information contained within successively read bar codes, and this signal is suitably coupled to an appropriate onboard computer (not shown) which develops relevant reverse-vending data.

Scanned containers which have passed through and downwardly beyond station 30 may be handled in different ways, and one of these is discussed in the '627 patent. Such post-scanning handling, and the means for accomplishing the same, do not form any part of the present invention, and thus are not further elaborated herein.

Accordingly, there has been disclosed and described herein, a novel rotary bristle mechanism which handles redeemable containers, such as soft-beverage cans, at a critical point in their transport through a reverse vending machine in such a fashion that they are positively presented to the view of an optical scanner which reads appropriate redemption-code information side-borne on such containers. This mechanism, accordingly, offers a high degree of reliability in obtaining accurate redemption-data information with respect to cans that a user presents to a machine for redemption. While the apparatus of the invention has been discussed herein in connection with the use of a single optical scanner, it is certainly possible that more than one scanner may be used for information acquisition redundancy if even greater reliability is desired. And, as mentioned earlier, other kinds of redeemable coded-beverage-container handling systems can incorporate the unique rotary bristle mechanism disclosed herein.

Accordingly, while a preferred embodiment, and a suggested modification, of the invention have been presented herein, other variations and modifications may become apparent to those skilled in the art which will come within the scope of the claims.

It is claimed and desired to secure by Letters Patent:

1. In a reverse vending machine for redeemable beverage containers which carry side-borne, optically readable information codes, means forming a generally upright, vertical-through-pass scanning station adapted to receive and pass successive containers which are fed endo to said station at least partially by gravity along a pass-through axis from a location above the station.

container-contacting, power-driven, rotary bristle means located adjacent, and in circumsurrounding fashion relative to, said station and said pass-through axis, adapted to contact such successively fed containers, and operable, via rotation about axes substantially paralleling said pass-through axis, and as a consequence interference contact force with containers, to impart rotary motion to contacted containers passing through the station, with such contacted containers rotating substantially on said pass-through axis, wherein said bristle means includes plural elongate, rotary brushes distributed generally angularly symmetrically around said station, each having a body, and bristles organized in a radiating, spiral pattern on said body, effective, with respect to a contacted container, to impart, in addition to rotation of such a container, a pass-through transport force urging the container downwardly through the station, and optical scanning means disposed outwardly and laterally of said station, operable to read the codes on containers so rotated within said station, and to produce related output signals which are interpretable to indicate information contents of such codes.

2. The organization of claim 1, wherein said spiral pattern is organized with change-pitch characteristics.

3. The organization of claim 1, wherein said bristles, along the length of the associated brush body, display differentiated-diameter characteristics.

4. The organization of claim 1, wherein said bristles, along the length of the associated brush body, display differentiated-diameter characteristics, and said spiral pattern is organized with change-pitch characteristics.

5. The organization of claim 3, wherein each brush body has upper and lower ends, and the associated bristles radiate therefrom to a small free-end diameter near the upper end, and to a larger free-end diameter near the lower end.

6. The organization of claim 4, wherein each brush body has upper and lower ends, and the associated bristles radiate therefrom to a smaller free-end diameter near the upper, and to the larger free-end diameter near the lower end.

* * * * *